United States Patent [19]

Harding

[11] Patent Number: 5,017,028

[45] Date of Patent: May 21, 1991

[54] SUBSTRATE CLAMPING APPARATUS FOR A THERMAL PRINTER

[75] Inventor: Paul R. Harding, Ewell, United Kingdom

[73] Assignee: Compular Limited, United Kingdom

[21] Appl. No.: 412,569

[22] Filed: Sep. 25, 1989

Related U.S. Application Data

[63] Continuation of Ser. No. 185,151, Apr. 22, 1988, abandoned.

[30] Foreign Application Priority Data

Apr. 28, 1987 [GB] United Kingdom ..... 8710059

[51] Int. Cl.[5] ..... B41J 2/315; B41F 1/28

[52] U.S. Cl. ..... 400/120; 101/474; 101/408; 400/48

[58] Field of Search ..... 400/120, 48, 611, 613.3; 101/93, 93.01, 93.04, 93.15, 409, 408, 474

[56] References Cited

U.S. PATENT DOCUMENTS

| | | | |
|---|---|---|---|
| 3,527,166 | 9/1970 | Jaffa | 101/474 |
| 3,712,442 | 1/1973 | Davies . | |
| 3,960,072 | 6/1976 | Ahlgren et al. . | |
| 3,989,131 | 11/1976 | Knirsch et al. | 400/120 |
| 4,120,245 | 10/1978 | Karp et al. | 400/48 |
| 4,620,807 | 11/1986 | Polit | 101/474 |
| 4,763,137 | 8/1988 | Damon et al. | 400/120 |

FOREIGN PATENT DOCUMENTS

| | | | |
|---|---|---|---|
| 0174295 | 10/1982 | Japan | 400/120 |
| 0001575 | 1/1983 | Japan | 400/120 |
| 0171367 | 4/1983 | Japan | 400/120 |
| 2030931 | 4/1980 | United Kingdom . | |

*Primary Examiner*—David A. Wiecking
*Assistant Examiner*—Joseph R. Keating
*Attorney, Agent, or Firm*—Wood, Phillips, Mason, Recktenwald & Vansanten

[57] ABSTRACT

Flat bed thermal printing apparatus adapted to print information on to an elongate substrate, or on to products disposed upon the substrate, at a printing area within the apparatus, the said substrate being movable through the apparatus in a step by step movement, with a stop for printing between each step, along a path which causes the substrate to be disposed in a substantially flat position as the substrate is stopped at the printing area after each step wherein the apparatus comprises a printing head provided with a multiplicity of individually energizable dot type thermal elements, means to move the printing head relative to the substrate while the substrate is stationary at the printing area between its stepwise movements through the apparatus with the substrate in its substantially flat disposition, means selectively to energize the said printing elements during movement of the printing head to effect printing and means positively to hold the substrate in position at the printing area during printing.

16 Claims, 4 Drawing Sheets

SUBSTRATE CLAMPING APPARATUS FOR A THERMAL PRINTER

This application is a continuation of application Ser. No. 185,151, filed Apr. 22, 1988, now abandoned.

This invention is concerned with printing apparatus and with an improved method of printing and is particularly concerned with the provision of flat bed thermal printing apparatus using a matrix of dots to form letters and/or symbols and devices. Thermal printers have become accepted during the last six years or so for example as computer output printers. There are two distinct types of thermal printer, a first type that uses a thermally sensitive substrate and a second type that uses a conventional substrate with a thermally sensitive ribbon between a printing head and the substrate. Printing apparatus in accordance with this invention may be used in either type of thermal printer. In both types of known thermal printer the substrate is fed around a rubber roller, called a platen, on to which the thermal printing head is pressed to effect printing. A substrate treated in that way is subjected to a substantial bending operation during printing so that conventional thermal printers are restricted to printing on to a flexible and bendable substrate. It is one object of the present invention to provide printing apparatus in which printing can be effected, if desired, on to an inflexible rigid or semi rigid substrate.

It is another object of the invention to provide printing apparatus in which the printed information can relatively easily be changed or varied by electronic or other suitable control means. According to the present invention there is provided flat bed printing apparatus adapted to print information on to an elongate substrate, or on to products disposed upon the substrate, at a printing area within the apparatus, the said substrate being movable through the apparatus in a step by step movement, with a stop for printing between each step, along a path which causes the substrate to be disposed in a substantially flat position as the substrate is stopped at the printing area after each step wherein the apparatus comprises a printing head provided with a multiplicity of individually energisable dot type thermal elements, means to move the printing head relative to the substrate while the substrate is stationery at the printing area between its stepwise movements through the apparatus with the substrate in its substantially flat disposition, means selectively to energise the said printing elements during movement of the printing head to effect printing and means positively to hold the substrate in position at the printing area during printing.

Printing apparatus in accordance with this invention is particularly useful for printing information on to a movable length of substrate, for example a roll of paper, carrying a number of spaced apart, possibly partially printed, labels on to which it is desired to print additional information e.g. the price of a particular product or a date by which a product should be sold or used. The printing head is preferably provided with a multiplicity of dot type heating elements arranged in a row at the end of the printing head and printing apparatus in accordance with this invention may be incorporated into a label applicator so that e.g. self adhesive labels having been printed may then be applied to products e.g. wrapped buns, loaves of bread or boxes or other products moving along on a conveyor belt or the like.

The printing head may be moved in one direction to effect printing which may be called the printing stroke. At the end of the printing stroke the printing head may be moved in the other direction back to its initial position ready for the next printing stroke and this movement may be called the return stroke. In apparatus using a thermally sensitive ribbon an unused portion of the ribbon is required for each printing stroke of the printing head.

In order that the invention may be more clearly understood reference is now directed to the accompanying drawings which illustrate by way of example the underlying idea of the invention when embodied into a thermal printer for printing information on to spaced apart labels disposed along an elongate substrate with a thermally sensitive ribbon between the printing head and the labels. In the drawings: FIG. 1 shows diagrammatically the general layout of a rapid printer system using printing apparatus in accordance with this invention, FIGS. 2 and 3 show how movement of the printing head and ribbon can be adapted to suit different shapes and sizes of label, the arrangement being such that the printing head and ribbon move parallel to the direction of movement or longitudinal axis of an elongate substrate in FIG. 2 and across the longitudinal axis in FIG. 3 so that the movement of the printing head and the amount of ribbon used is the smaller dimension of the printing area in each case, FIG. 4 illustrates, for comparison purposes, a known form of printing head in operation for dot printing on to a flexible substrate which is wound over a platen, FIGS. 5, 6 and 7 are respectively a top plan view, a side view and an end view of a printing head for use in printing apparatus in accordance with this invention.

Figure 1:
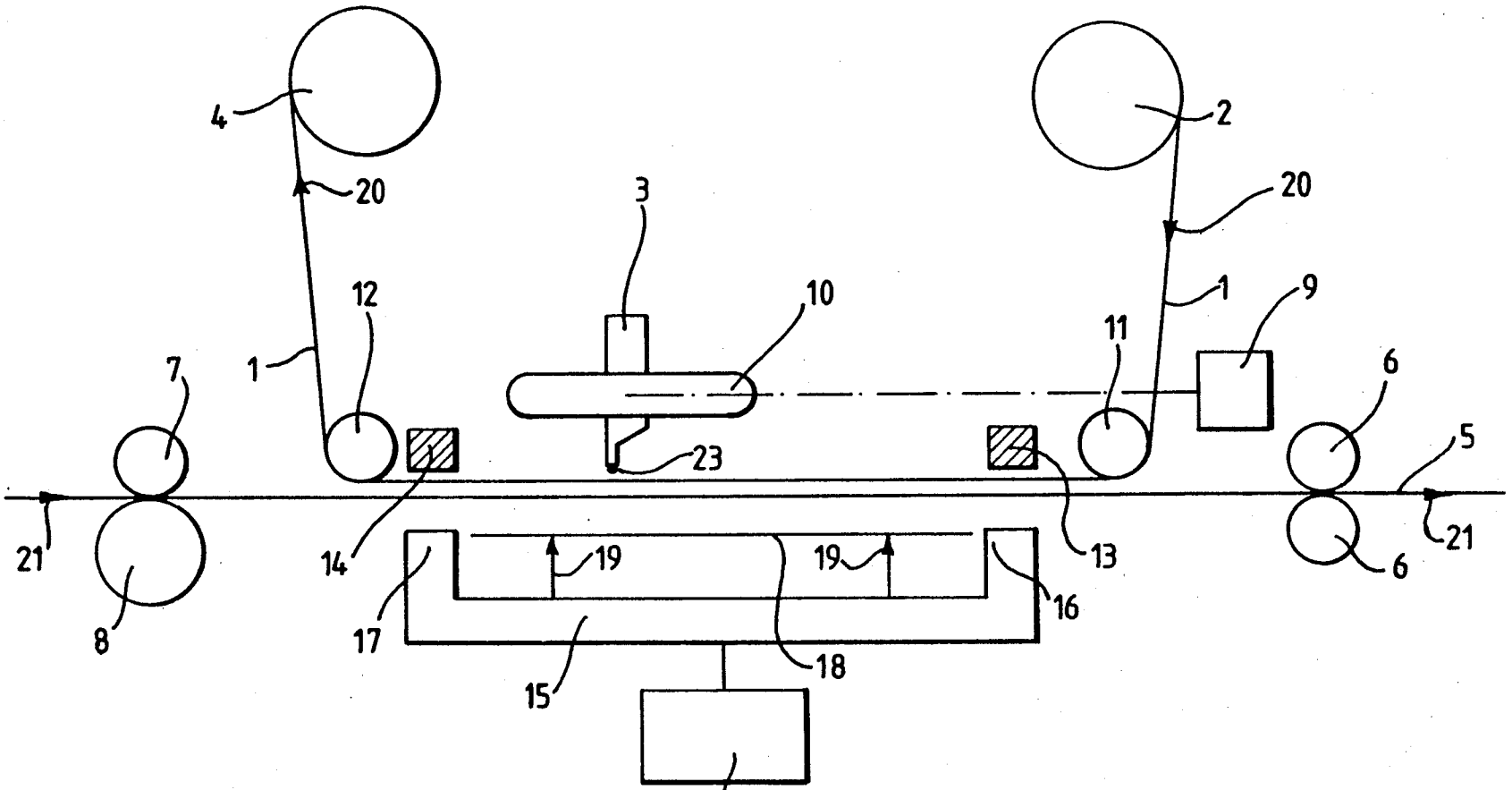

Referring first to FIG. 1 it will be noted that heat sensitive ribbon 1 is unwound from supply reel 2 is moved past a printing head 3 and is wound on to a take up reel 4. A length of substrate 5 is shown being fed past the head 3, from a substrate advance roll 7 which cooperates with a pinch wheel 8 to guide rolls 6. A motor or motors 9 is/are indicated outside the line of movement of the ribbon 1 for moving a carriage 10 which is shown in its start position and which carries the printing head 3. Ribbon guide rolls 11 and 12 are shown and 13, 14 are clamp members which cooperate with a clamp chassis 15 carrying clamp arms 16, 17 which abut against the clamp members 13, 14 with the ribbon and substrate in between during printing which is effected while the substrate is supported by a head pressure or support plate 18 which forms the flat bed and which is movable by means of a solenoid 22 or by other means such as compressed air in the direction of the arrows 19 as the movement of the substrate is stopped for printing.

In operation the ribbon 1 is moved intermittently or step by step in the direction of the arrows 20 between printing operations and the substrate is moved intermittently or step by step in the direction of the arrows 21. When the substrate has moved a label S into the printing area e.g. when a label to be printed or over-printed is below the printing head 3 the movement of the substrate 5 is momentarily stopped and the solenoid 22 or other means is energised to raise the clamp chassis 15 into its clamping position. The print head carriage 10 is then operated to move the printing head S, which carries a multiplicity of heating elements 23, arranged in a row, across the surface of ribbon 1/substrate 5 to print an appropriate array of dots in a row on the label. The printing head is then moved and another row of dots is produced and so on until the predetermined symbols have been printed onto the label on the substrate 5, the elements 23 being selectively energised during printing to build up the predetermined symbols. It will be understood that the movement of the various elements described will be synchronized by electronic or other suitable means. After printing of a label has been completed the chassis 15 is immediately lowered, the ribbon 1 and substrate 5 are fed in the appropriate directions by predetermined amounts until the next label on the substrate is below the printing head and the operation is repeated. The movement of the print head carriage 10 carrying the print head S over the ribbon/substrate for printing may be alternately in opposite directions or may always be in the same direction if the printing head be returned to its start position before another printing stroke i.e. in a case in which the printing stroke of the printing head is always in the same direction.

Figure 2:
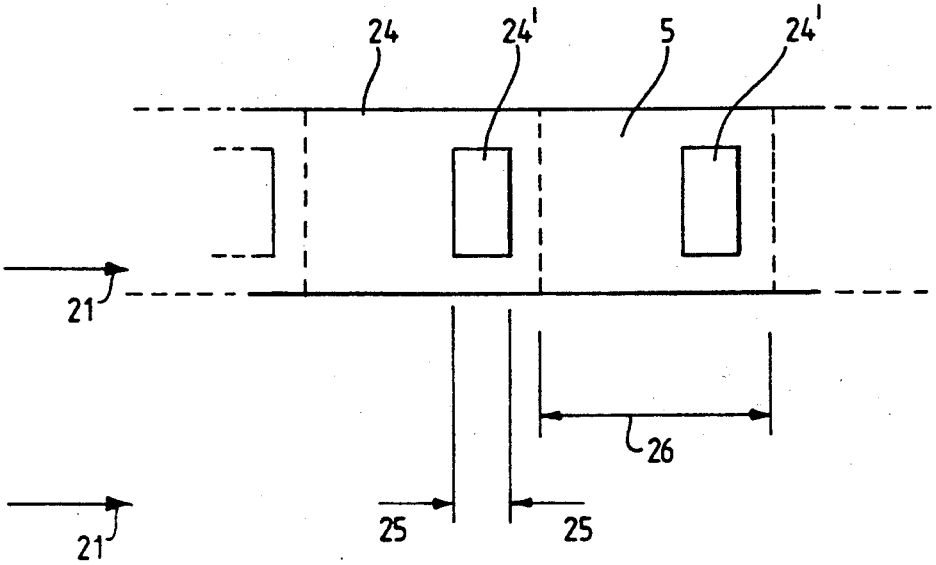

Referring now to FIG. 2 it will be seen that the substrate 5 carries labels or text blocks 24 each of which includes an area 24' to be overprinted, the longer axis of each area 24' lying across the axis of movement of the substrate. In this case the printing movement of the head 3 is arranged to be in the direction of motion of the substrate 5 shown by arrow 21 or opposite thereto i.e. printing head 3 and the ribbon move parallel to the axis of movement of the substrate 5, the ribbon being moved between printing operations in a direction opposite to that indicated by arrow 21. The result of this arrangement is that the amount of ribbon used and the length of movement of the printing head 3 cover the smaller dimension of the overprint area shown by arrows 25, the distance of movement of the substrate between stops being indicated by the double arrow 26.

Figure 3:
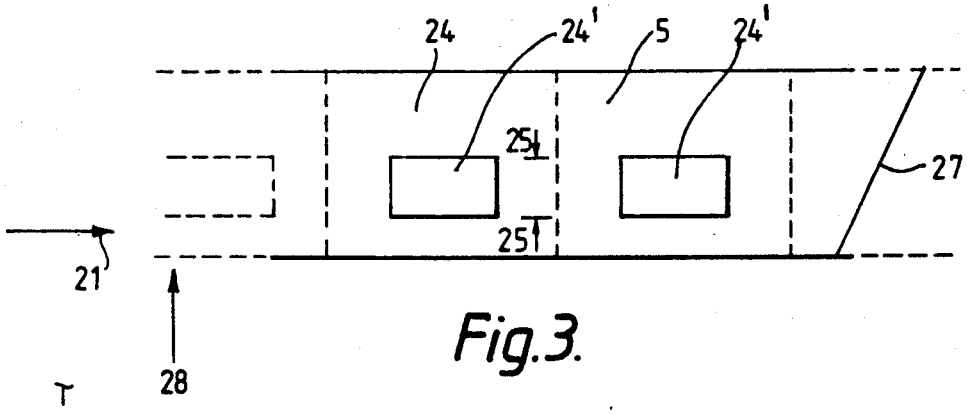
Figure 4:
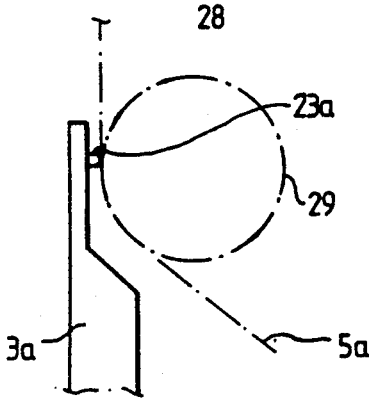

In FIG. 3, as the longer axis of the overprint area 24', is parallel to the direction of movement 21 of the substrate, the printing head is moved at right angles to the direction of movement of the substrate, see arrow 28 by changing the direction of movement of the substrate. As the substrate is fed forward between printing operations the ribbon is also fed parallel to the direction of movement of the substrate but in the opposite direction so that the ribbon used and the amount of movement of the head 3 still covers only the smaller dimension of the overprint area. It will, however, be understood that printing movement of the printing head is not restricted to movement parallel to or at 90° to the axis of movement of the substrate. If desired for any reason the head my be adjusted so as to be moved at any angle across the substrate e.g. in the direction indicated by line 27 in FIG. 3. Although not shown in any of the figures, it is understood that the printing head is moved by means of a conventional electric motor which is synchronized with the movement of the substrate. FIG. 4, which is included purely for comparison purposes, shows known apparatus including a printing head **3*a* with heating elements 23*a* at the side, printing being effected as the flexible substrate 5*a* is moved around a platen or roll 29**.

Figure 5:
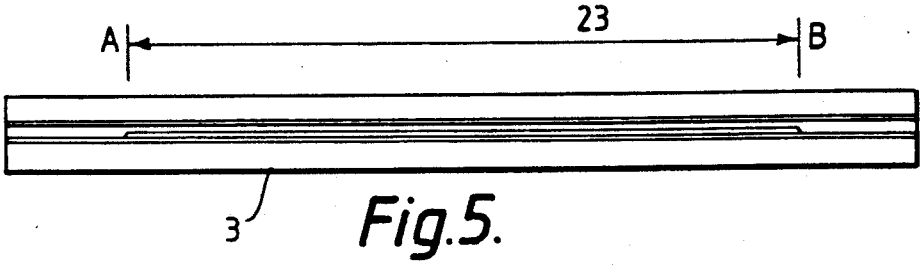
Figure 6:
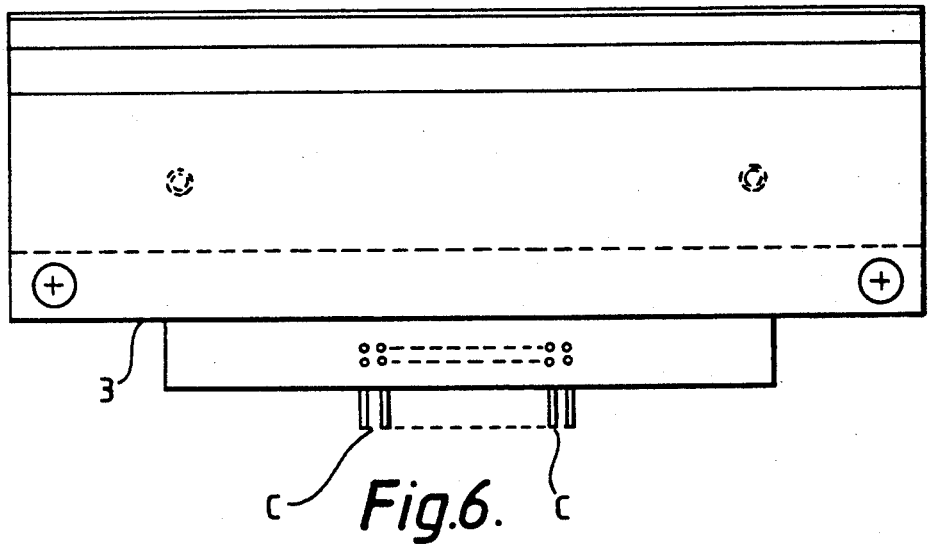
Figure 7:
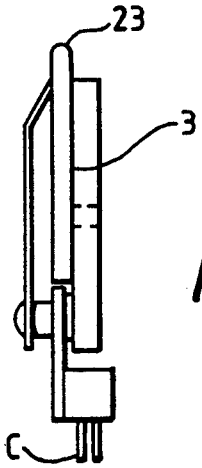

In flat bed apparatus according to the present invention printing is effected with the substrate in a substantially horizontal or other substantially straight line planar position so that by using a printing head 3 as shown in FIGS. 5, 6 and 7 with a multiplicity of heating elements 23 arranged in a row at the very end, instead of at the side, we can if desired print on rigid or relatively rigid objects such as credit cards made of plastics material arranged on a substrate which cannot easily be wound around a platen. FIGS. 5, 6 and 7 show in actual size constructional details of a preferred form of printing head but a full description of the construction is not considered to be necessary. It may suffice to say that the printing width is indicated in FIG. 5 by the line A-8. In the particular embodiment shown by way of example 800 heating elements are included in a row between ends A and B so that the individual elements are too small to indicate separately. Electrical connectors are indicated at C.

Figure 8:
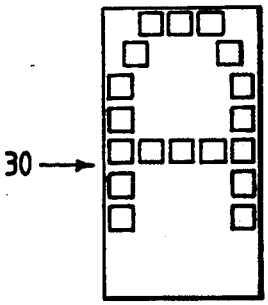
FIG. 8 shows a letter A produced by dot printing.

FIG. 8 shows a letter A made up by dot printing by moving the printing head in the direction of the arrow 30, the appropriate elements 23 being energised as the head moves to build up the required design. It will be understood that in practice the dots will appear much closer together than shown in FIG. 8 which is purely diagrammatic for explanatory purposes. Comparing FIG. 8 with FIG. 2 it will be understood that the printing head moves from left to right to cover the smaller dimension of the area 24' while the length of the printing head including the row A-B of printing elements extends parallel to the longer dimension of the area 24'.

The apparatus may be operated with the printing area in substantially any orientation, that is to say it is not necessary that the printing area should be horizontal with the printing head above the substrate As described above, FIG. 9 is a perspective view of a practical form of printing apparatus in accordance with the present invention, the same references being used for corresponding parts in FIGS. 1 to 9. In the embodiment illustrated in FIG. 9 the substrate 5 (not shown) moves through the machine exiting along the line of arrow 21 or alternatively may exit along the same path as the ribbon 1 in the direction indicated by the arrow 56.

Figure 9:
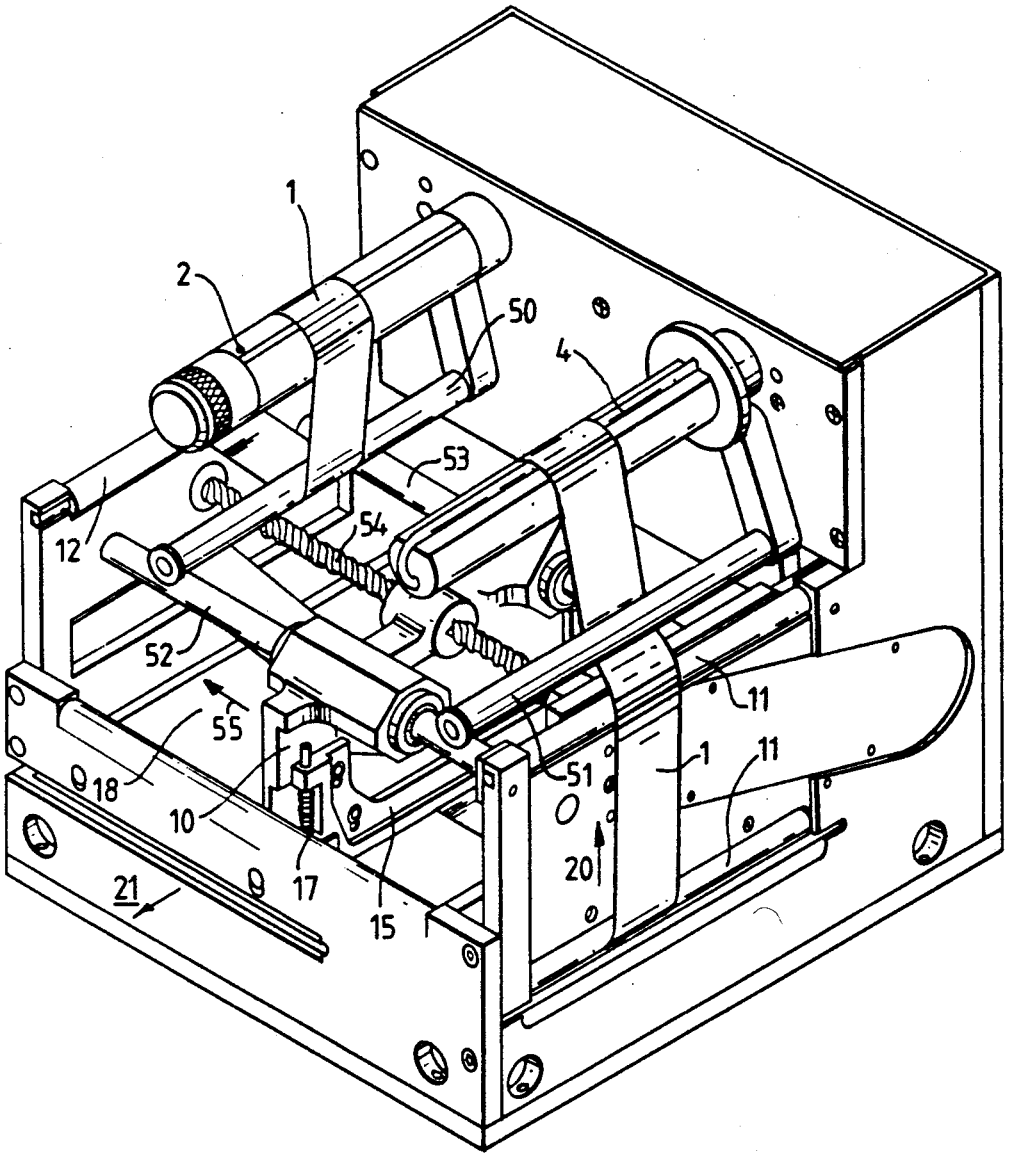
FIG. 9 is a perspective of pictorial view of a practical form of flat bed thermal printing apparatus in accordance with the present invention.

It will be realized that when the substrate exits along the line of arrow 56, printing is parallel to the direction of movement of the substrate in FIG. 9 having regard to the disposition of the printing head. On the other hand, if the substrate exits along the line of arrow 21, printing is transverse to the direction of movement. The ribbon 1 is moved from the lefthand reel 2 to the righthand reel 4. A feed ribbon swing arm 50 allows the head carriage 10 to pull ribbon from a reservoir or supply reel of unwound ribbon while a take up swing arm 51 keeps the ribbon 1 taut until the take up reel 4 accelerates and takes up the used ribbon. Both the feed and take up reels 2, 4 are controlled by the positions of their respective swing arms 50, 51. The head carriage 10 is moved along to guide bars 52, 53 by a lead screw 54 which is driven by a motor. Head contact with the substrate is maintained by springs 17 mounted on the head carriage 10. The head carriage 10 and hence the printing head 3 is moved from front right to back left in FIG. 9 in the direction of arrow 55 at a constant velocity and the print elements 23 are appropriately energized. The return stroke of the head carriage grips the ribbon and pulls that through by the amount used. In this embodiment, the head carriage 10, and hence the printing head 3, is moved in a direction 28 at right angles to the direction of movement 21 of the substrate.

I claim:

1. A flat bed thermal printing machine adapted to print information at a printing area within the machine on to a defined printing space of a substrate or on to a defined printing space on products disposed upon said substrate using either a thermally sensitive ribbon or a thermally sensitive substrate, said substrate being movable through the machine in a step by step movement whereby each step brings a new printing space into the printing area, the substrate being stopped for printing between each step and being moved along a path which causes a printing space of the substrate to be disposed in a substantially flat position at the printing area as the substrate is stopped for printing, the machine comprising:

a printing head having thermal printing means, including a multiplicity of individually energisable dot type thermal elements for printing over a given portion of the surface of said defined printing space when the printing head is moved relative to the substrate;

means for moving the printing head relative to the substrate while the substrate is stationary at the printing area between its stepwise movements;

means for selectively energizing said thermal elements during movement of the printing head to effect printing;

means for positively clamping the substrate stationary at the printing area during each printing operation, and for releasing the substrate for movement between printing operations, said clamping and releasing means being disposed such that the substrate is gripped at a plurality of points which lie in substantially the same plane as the surface of the defined printing space; and flat bed means, extending over the whole of the printing area, for providing localized support for the substrate when at the printing area such that said machine is adapted to use a substrate having a substantially rigid printing area portion without significantly bending said portion.

2. A printing machine according to claim 1 adapted to print information on to spaced apart labels disposed along the length of the substrate, each label forming an individual defined printing space.

3. A printing machine according to claim 1 wherein the printing head is provided with said multiplicity of thermal elements arranged in a row at the end of the printing head, and wherein said thermal element row is of sufficient length such that the entirety of the defined printing space is printed during the movement of the print head in a single direction.

4. A printing machine according to claim 1 wherein printing can be effected in any desired direction relative to the direction of substrate movement.

5. A printing machine according to claim 1 wherein the printing head is movable in one direction to effect printing and is movable in the opposite direction to return to its start position.

6. A printing machine according to claim 1 wherein the substrate is gripped at opposite borders of the printing space while the printing head is moved during its printing stroke.

7. A printing machine according to claim 6 wherein said opposite borders of the printing space are substantially perpendicular to the direction of movement of the printing head.

8. A printing machine according to claim 1 wherein said means for clamping and releasing includes a clamp chassis having a plurality of clamp arms disposed on one side of the substrate which cooperate with a plurality of clamp members disposed on the other side of the substrate so as to positively grip the substrate therebetween.

9. A printing machine according to claim 1 wherein the substrate is disposed in a perfectly flat position at the printing area as the substrate is stopped for printing.

10. A printing machine according to claim 1 wherein said printing head has at least 100 individually energisable dot type thermal elements.

11. A flat bed thermal printing machine adapted to print information at a printing area within the machine on to labels spaced apart along a continuous length of substrate using a thermally sensitive ribbon, said substrate being movable through the machine in a required direction in a step by step movement whereby each step brings a new label into the printing area, the substrate being stopped for printing between each step and being moved along a path which causes said label to be disposed in a flat position as the substrate is stopped for printing, the machine comprising:

a printing head having thermal printing means, including a multiplicity of individually energisable dot type thermal elements, for printing over a given portion of the surface of a label when the printing head is moved relative to the substrate;

means for moving the printing head relative to the substrate while the substrate is stationary at the printing area between its stepwise movements;

means for selectively energizing said thermal elements during movement of the printing head to effect printing;

a flat bed means, extending over the whole of the printing area, for providing localized support for the label and substrate over at least the label surface when a label is positioned at the printing area; and means for positively clamping the substrate stationary with a label at the printing area such that the substrate is securely fixed to said flat bed means during each printing operation, and for releasing the substrate for movement between printing operations, said clamping and releasing means being disposed such that the substrate is gripped at a plurality of points which lie in substantially the same plane as the label being printed, thereby minimizing any buckling of the label during the printing operation.

12. A printing machine according to claim 11 wherein the substrate is gripped at least two points which lie adjacent opposite borders of the label to be printed.

13. A printing machine according to claim 12 wherein said two points define a line substantially parallel to the direction of movement of the printing head during its printing stroke.

14. A printing machine according to claim 11 wherein said means for clamping and releasing includes a clamp chassis having a plurality of clamp arms disposed on one side of the substrate which cooperate with a plurality of clamp members disposed on the other side of the substrate so as to positively grip the substrate therebetween.

15. A printing machine according to claim 11 wherein an entire label is disposed in a perfectly flat position at the printing area as the substrate is stopped for printing.

16. A printing machine according to claim 11 wherein said printing head has at least 100 individually energisable dot type thermal elements.

* * * * *